US005795445A

United States Patent [19]

Boswell et al.

[11] Patent Number: 5,795,445

[45] Date of Patent: Aug. 18, 1998

[54] METHOD OF CONTROLLING THE QUENCH OF COKE IN A COKE DRUM

[75] Inventors: Richard S. Boswell, Magnolia, Tex.; Thomas D. Farraro, Lake Charles, La.

[73] Assignee: Citgo Petroleum Corporation, Tulsa, Okla.

[21] Appl. No.: 677,802

[22] Filed: Jul. 10, 1996

[51] Int. Cl.[6] ..... C10B 39/08; C10B 57/02

[52] U.S. Cl. ..... 201/39; 201/1; 201/39; 202/227

[58] Field of Search ..... 201/1, 39; 202/227

[56] References Cited

U.S. PATENT DOCUMENTS

| | | | |
|---|---|---|---|
| 1,065,081 | 6/1913 | Reubold | 202/229 |
| 3,611,787 | 10/1971 | D'Annessa et al. | 73/15.6 |
| 3,780,888 | 12/1973 | Hoffman | 214/18 K |
| 3,917,516 | 11/1975 | Waldmann et al. | 202/227 |
| 3,936,358 | 2/1976 | Little | 201/39 |
| 4,135,986 | 1/1979 | Cain et al. | 202/227 |
| 4,147,594 | 4/1979 | Cain et al. | 201/39 |
| 4,282,068 | 8/1981 | Flockenhaus et al. | 202/227 |
| 4,284,478 | 8/1981 | Brommel | 202/227 |
| 4,285,772 | 8/1981 | Kress | 201/39 |
| 4,289,585 | 9/1981 | Wagener et al. | 202/227 |
| 4,294,663 | 10/1981 | Tennyson | 201/39 |
| 4,312,711 | 1/1982 | Brown et al. | 202/227 |
| 4,344,822 | 8/1982 | Schwartz et al. | 201/39 |
| 4,358,343 | 11/1982 | Goedde et al. | 201/1 |
| 4,396,461 | 8/1983 | Neubaum et al. | 201/39 |
| 4,409,067 | 10/1983 | Smith | 201/1 |
| 4,437,936 | 3/1984 | Jung | 201/39 |
| 4,469,557 | 9/1984 | Schweer et al. | 201/17 |
| 4,512,850 | 4/1985 | Mosebach | 201/1 |
| 4,557,804 | 12/1985 | Baumgartner et al. | 202/227 |
| 4,588,479 | 5/1986 | Weber et al. | 202/228 |
| 4,614,567 | 9/1986 | Stahlherm et al. | 201/1 |
| 4,634,500 | 1/1987 | Elliott et al. | 201/39 |
| 4,644,750 | 2/1987 | Lockett et al. | 60/641.2 |
| 4,726,465 | 2/1988 | Kwasnik et al. | 202/230 |
| 4,743,342 | 5/1988 | Pollert et al. | 202/227 |
| 4,747,913 | 5/1988 | Gerstenkorn et al. | 202/227 |
| 4,772,360 | 9/1988 | Beckmann et al. | 202/227 |
| 4,802,573 | 2/1989 | Holter et al. | 201/39 |
| 4,832,795 | 5/1989 | Lorenz et al. | 202/228 |
| 4,886,580 | 12/1989 | Kress et al. | 202/228 |
| 4,997,527 | 3/1991 | Kress et al. | 201/39 |
| 5,024,730 | 6/1991 | Colvert | 196/132 |

FOREIGN PATENT DOCUMENTS

| | | |
|---|---|---|
| 0 209 285 A | 1/1987 | European Pat. Off. . |
| 63-085324 | 4/1988 | Japan . |

*Primary Examiner*—Tae Yoon
*Attorney, Agent, or Firm*—Head, Johnson & Kachigian

[57] ABSTRACT

A method of controlling the rate of quench of coke in a coke drum to reduce deterioration of the coke drum sidewall in which water is admitted into the coke drum filled with hot coke to cool the coke includes the steps of determining the stress imposed on the coke drum sidewall by means of at least one strain gauge affixed to the sidewall and controlling the rate of admission of water into the coke drum in response to the determined stress so that the rate of water admission keeps the stress below a preselected maximum level.

9 Claims, 1 Drawing Sheet

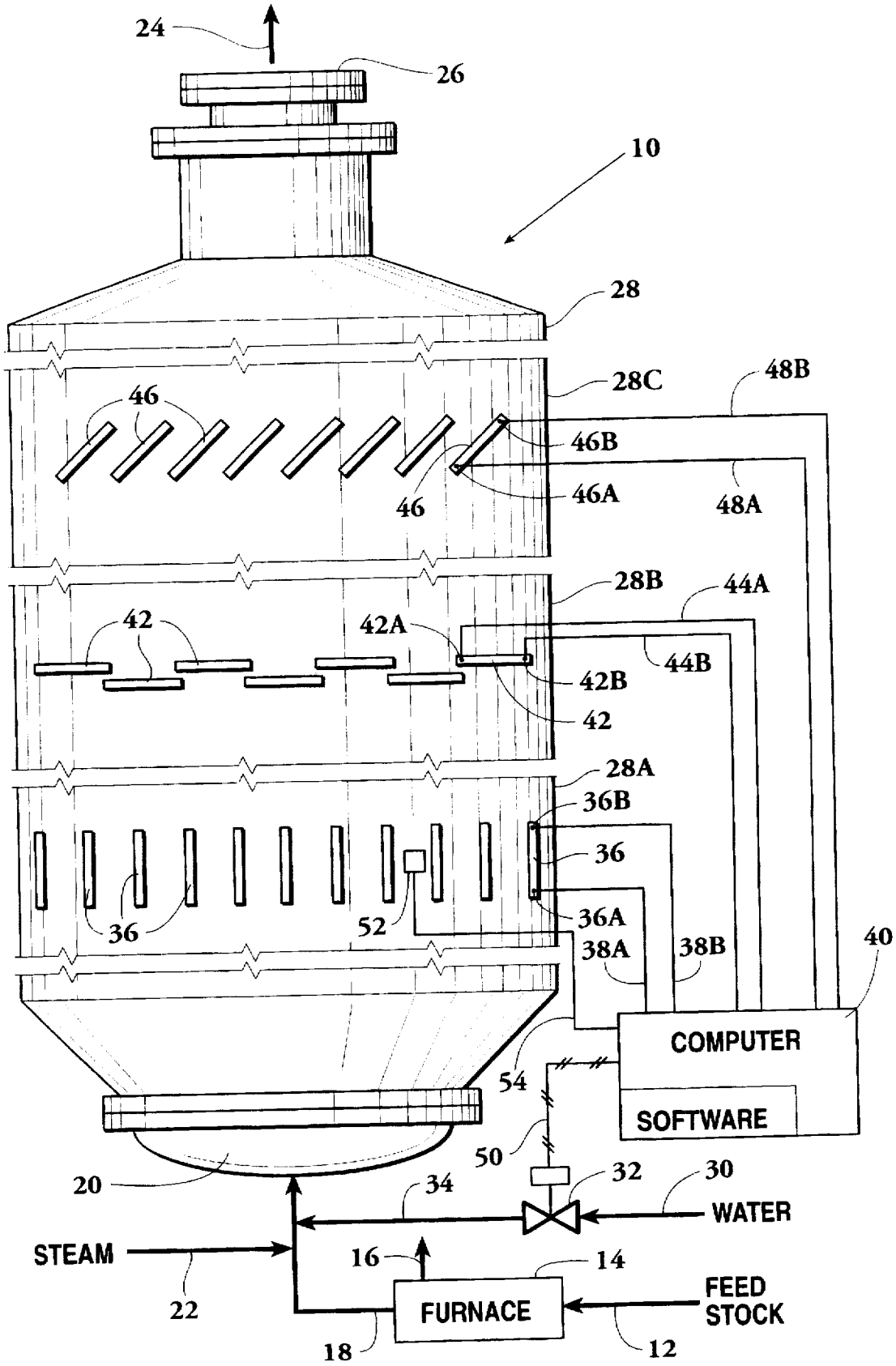
24
26
10
28
28C
48B
46
46B
46
46A
48A
28B
44A
42
42A
44B
42B
42
28A
36B
36
36
52
36A
38A
38B
40
COMPUTER
54
SOFTWARE
50
20
34
32
30
WATER
STEAM
16
14
22
FURNACE
FEED STOCK
18
12

METHOD OF CONTROLLING THE QUENCH OF COKE IN A COKE DRUM

BACKGROUND OF THE INVENTION

In petroleum refining operations in which crude oil is processed to produce gasoline, diesel fuel, lubricants and so forth, there always remains a residue that is referred to in the trade as "coke". This residue is heated in a furnace to cause destructive distillation of the hydrocarbon feed stock in which substantially all of the remaining useable hydrocarbon products are driven from the residue, leaving the coke product which is conveyed into a coke drum. The typical coke drum is a large, upright, cylindrical, steel walled vessel that may, for example, be in the order of approximately 90–100 feet in height and 20–30 feet in diameter, although the actual structural size and shape of the coke drum can vary considerably from one installation to another. Typically, a refinery has a plurality of coke drums, the production of coke being a batch process, that is, wherein coke is deposited in a very hot state in a drum, is cooled using a process that is the subject of this invention, and after cooling, the coke is removed, the drum then being ready for reuse. While coke is being cooled in one or more drums and while the cooled coke is being extracted, other drums are being employed to receive the continuous production of coke as a part of the operation of a refining process.

Typically, the residue feed stock from a refinery operation is fed through a furnace where distillation occurs. The output of the furnace is a residue that is substantially free of all higher order hydrocarbons. The residue is in the form of a hot vicious liquid product that is fed into a coke drum at a temperature of about 900° F. The hot liquid material fills the drum to approximately 80% of its capacity. Due to the high temperature (about 900° as an example) of the liquid product entering the coke drum, the drum thermally expands both longitudinally and circumferentially to thereby have a larger volume than when the drum is cold. The hot liquid coke enters the drum, typically flowing into the bottom of the drum and lays down layers of coke that solidifies as the temperature drops. Eventually the coke drum becomes a solid mass with flow channels kept molten by the hot product entering the drum.

When a coke drum is filled to the desired capacity, or during the process of filling, steam is typically introduced into the drum to drive off any remaining hydrocarbon vapors. The drum remains substantially full of coke that, as it cools, hardens into a solid material.

Since the coke, as it transforms from a liquid to a solid, is exceedingly hot and since the coke cannot be discharged from the coke drum as a solid product until it is cooled to substantially ambient temperature, some means must be provided for cooling the coke in the drum otherwise it would take an inordinate length of time for the coke to cool as a result of ambient temperature alone. Consequentially it is a standard procedure to cool coke in a drum by the admission of quench water.

In the coke drum, the drum sidewalls shrink both longitudinally and circumferentially due to thermal contraction of the metal of which the sidewalls are formed. As the coke cools, it is transformed from a liquid to a solid phase and the coke drum thermally constricts around the solidified coke tending to crush and compact the coke. This thermal contraction of the coke drum sidewall, both circumferentially and longitudinally, which shrinkage is counteracted by the resistance to shrinkage of the solidified coke, introduces substantial stress in the coke drum metal sidewalls. This thermal stress results in deterioration of the coke drum sidewalls and unless the rate of stress is controlled to keep the stress below a preselected maximum level, failure of the coke drum sidewall will result. More specifically, if the program of quenching is carried out in such a way that the quenching operation repeatably introduces excessive stress in the coke drum sidewalls as repeated batches of cokes are quenched, the life expectancy of a coke drum is substantially reduced.

It is an object of the present disclosure to provide an improved means of controlling the rate of quench of coke in a coke drum to reduce the rate of deterioration of the coke drum sidewall.

Others have suggested methods of controlling the quenching rate in coke drums and for background information, reference may be had to U.S. Pat. No. 4,634,500 issued Jan. 6, 1987 and entitled "Method of Quenching Heated Coke To Limit Coke Drum Stress". This patent discloses a method of controlling the quenching of coke in a coke drum in which the longitudinal thermal temperature gradient along the coke drum wall is measured. This longitudinal temperature measurement is compared with a predetermined gradient parameter for the coke drum and the rate of flow of quenching water into the drum is controlled as a result of such comparison. Measuring a longitudinal thermal temperature gradient along the coke sidewall does not provide a direct indication of thermal stress taking place within the coke drum sidewall and requires that the stress actually taking place be implied from the thermal gradient temperature measurements. In contrast, the present disclosure employs a unique system of direct stress measurement that more rapidly and more accurately indicates the actual conditions of a coke drum sidewall to more rapidly and accurately control the quenching operation to permit the quenching operation to be conducted in such a way as to minimize deterioration of the coke drum sidewall.

U.S. Pat. No. 3,936,358 issued Feb. 3, 1976, entitled "Method of Controlling The Feed Rate of Quenched Water To A Coking Drum In Response To The Internal Pressure Therein" teaches, as the title of the patent implies, a method of controlling a quenching operation of a coke drum in response to the internal pressure measured within the drum. Measuring the internal pressure requires that the stress be implied. Further, the actual pressure within a coke drum does not accurately reflect the stress caused by the resistance to thermal contraction imposed by solidified coke within a drum.

For further background information relating to quenching of coke, reference may be had to the following additional United States patents:

| PATENT NO. | INVENTOR | TITLE |
|---|---|---|
| 1065081 | Reubold | Apparatus For Quenching Coke |
| 3611787 | D'Annessa et al | Apparatus For Minimizing Thermal Gradient In Test Specimens |
| 3780888 | Hoffman | Material Transfer Apparatus For A Rotary Drum |
| 3917516 | Waldmann et al | Coke-Cooling Apparatus |
| 3936358 | Little | Method of Controlling The Feed Rate of Quench Water To A Coking Drum In Response To The Internal Pressure Therein |
| 4135986 | Cain et al | Qne-Spot Rotary Coke |

-continued

| PATENT NO. | INVENTOR | TITLE |
|---|---|---|
| | | Quenching Car |
| 4147594 | Cain et al | One-Spot Cylindrical Coke Quenching Car and Quenching Method |
| 4282068 | Flockenhaus et al | Apparatus For The Transfer and Quenching of Coke |
| 4284478 | Brommel | Apparatus For Quenching Hot Coke |
| 4285772 | Kress | Method and Apparatus For Handling and Dry Quenching Coke |
| 4289585 | Wagener et al | Method and Apparatus For The Wet Quenching of Coke |
| 4294663 | Tennyson | Method For Operating A Coke Quench Tower Scrubber System |
| 4312711 | Brown et al | Fluid Cooled Quenching Cars |
| 4344822 | Schwartz et al | One-Spot Car Coke Quenching Method |
| 4358343 | Goedde et al | Method For Quenching Coke |
| 4396461 | Neubaum et al | One-Spot Car Coke Quenching Process |
| 4409067 | Smith | Quenching Method and Apparatus |
| 4437936 | Jung | Process For Utilizing Waste Heat and For Obtaining Water Gas During The Cooling of Incandescent Coke |
| 4469557 | Schweer et al | Process For Calcining and Carbonizing Petroleum Coke |
| 4512850 | Mosebach | Process For Wet Quenching Of Coal-Coke |
| 4557804 | Baumgartner et al | Coke Cooler |
| 4588479 | Weber et al | Device For Cooling Incandescent Coke |
| 4614567 | Stahlherm et al | Method and Apparatus For Selective After-Quenching Of Coke On A Coke Bench |
| 4634500 | Elliott et al | Method of Quenching Heated Coke To Limit Coke Drum Stress |
| 4664750 | Biesheuvel et al | Method For Coke Quenching Control |
| 4726465 | Kwasnik et al | Coke Quenching Car |
| 4743342 | Pollert et al | Coke Quenching Apparatus |
| 4747913 | Gerstenkorn et al | Cooling Apparatus For Granular Coke Material |
| 4772360 | Beckmann et al | Thin Wall Coke Quenching Container |
| 4802573 | Holter et al | Process For Wet Quenching Of Coke |
| 4832795 | Lorenz et al | Coke Dry Cooling Chamber |
| 4886580 | Kress et al | Dry Quenching Coke Box |
| 4997527 | Kress et al | Coke Handling and Dry Quenching Method |
| 5024730 | Colvert | Control System For Delayed Coker |

BRIEF SUMMARY OF THE INVENTION

This invention provides a method of controlling the rate of quench of coke in a coke drum to reduce the rate of deterioration of the coke drum sidewall. The method includes the steps of admitting water into a hot coke drum to cool the coke therein. The stress imposed on the coke drum sidewall as a consequence of the cooling effect of the water entering the coke drum is directly measured by means of at least one strain gauge (but more preferably, a plurality of strain gauges) affixed to the coke drum sidewall. The rate of admission of water into the coke drum is then controlled in response to the determined stress of the coke drum sidewall to a rate that results in the determined stress remains below a preselected maximum level.

In a preferred method of practicing the invention, a plurality of strain gauges are affixed to the exterior surface of a coke drum sidewall in a predetermined pattern that may include placement of the strain gauges either in a vertically aligned pattern or in a horizontally aligned pattern or in a pattern wherein the axis of the individual strain gauges are at an angle with relative to the vertical axis of the drum.

An actual strain measurement from at least one but preferably measurements from a plurality of strain gauges are fed to a computer wherein the stress detected by the strain gauge is or gauges are analyzed employing appropriate software to determine the level of stress actually being experienced by a coke drum as quench water is introduced. Employing the information derived from strain gauge or gauges, the program then provides appropriate electrical signals for controlling a valve that governs the rate of quench water flow into the coke drum to thereby maintain a rate of water flowage into the coke drum to a level that results in the drum sidewall stress being kept below a preselected maximum level to thereby insure a rate of stress deterioration of the vessel sidewall that is within acceptable limits. In one embodiment, the computer program determines the rate of stress increase and calculates the rate of quench water flow consonant with the rate of stress increase so that the stress in the vessel sidewall remaining below a predetermined level.

A better understanding of the invention will be obtained from the following description of the preferred embodiments and the claims, taken in conjunction with the attached drawings.

DESCRIPTION OF THE DRAWINGS

The drawing is a schematic diagram of the system of this invention illustrating, in broken away segments, a coke drum and the sidewall thereof having diagrammatically illustrated strain gauges secured thereto and showing schematically the use of information collected by a plurality of strain gauges for producing an electrical signal to control a valve that determines the rate of quenching water flow into the coke drum.

DETAILED DESCRIPTION OF THE PREFERRED EMBODIMENTS

Referring to the drawing, a coke drum is indicated generally by the numeral 10, the drum being illustrated diagrammatically rather than pictorially. Coke drums 10 are commonly employed in refinery operations for receiving the residue after substantially all useable higher hydrocarbons have been extracted from crude oil. The useful and valuable higher hydrocarbons obtained from crude oil include gasoline, diesel fuel and lubricants, as well as a host of other products utilized by the transportation and chemical manufacturing industry. After all of these valuable and highly useful products are removed from the crude oil in the refinery process there remains a residue product that is in the form, after it has solidified, commonly referred to as "coke". This product, which is essentially carbon, must be dealt with in a refinery operation. It has some commercial value, although the value per volume is much lower than other products derived from crude oil.

The residue from the refinery operation in the form of the coking feed stock is supplied through piping 12. This liquid material is fed to a furnace 14 where destructive distillation takes place with gases generated by the destructive distillation passing off at 16, which gases are collected and useful components thereof extracted. The output from furnace 14 passes by conduit 18 into a bottom section 20 of coke drum 10. The liquid product flowing into drum 10 through conduit 18 is typically at a temperature of about 900° F. This liquid material is fed into drum 10 until it is typically about 80% filled. When the drum is filled to this level, further flow of feed stock from conduit 18 is terminated and the flow of feed stock is then routed to another coke drum and the process is repeated. Thus, in a refinery operation, there are sufficient coke drums of the type identified by the numeral 10 to permit liquidified coke to be fed into the drum, the coke cooled and removed as a solid and the drum then continuously reused in batch processes.

After the liquid coke at typically 900° F. fills the drum 10 and further flow is terminated, the coke must be cooled to a temperature of near ambient before the material is removed as a solid and the drum then prepared to receive a new batch of coke. Since it would be exceedingly time consuming to permit the coke in drum 10 to cool by dissipating heat into the ambient environment, that is, the air surrounding the coke drum, the usual process in refining operations is to quench the coke in drum 10 by the introduction of quenching water. However, before quenching water is introduced, a common procedure is to introduce steam into drum 10, the steam flowing through conduit 22 into the bottom of vessel 10. Steam passes upwardly through the coke, either as the coke is being conveyed into the drum or after the drum is substantially filled, the steam serving to begin the cooling process and, in addition, to drive off any entrained hydrocarbon vapors. The steam and commingled vapors pass out through vapor outlet 24 in the top end portion 26 of the drum, any entrained hydrocarbons being recovered.

Vessel 10 has a cylindrical wall 28 extending between bottom 20 and top 26. Vessel 10 may have a cylindrical sidewall of a height such as about 90–100 feet and a diameter of about 20 feet, although these dimensions can vary considerably and the exact dimensions are not related to the essence of the invention. The coke drum illustrated in the drawing is, as has been previously stated, schematic only and the details of construction of the coke drum are not part of the invention. Instead, the invention is concerned with controlling the quenching of coke within vessel 10 in a way to limit deterioration of the coke drum sidewall 28.

Vessel 10 is preferably made of metal and most preferably steel because of its strength and economy compared to other comparable metal. Steel, like all metals, has a thermal expansion characteristic so that as the hot coke enters drum 10, the sidewall 28 thereof expands both longitudinally and circumferentially, meaning that the height of the drum increases as the temperature of the sidewall increases to reflect the temperature of the coke and that the diameter of the drum increases. The longitudinal and circumferential change of dimension of the drum does not take place uniformly but instead takes place in a highly localized manner, that is, as the hot coke enters the drum from the bottom and builds in layers, portions of the drum sidewall 28 contacted by the hot coke increase in dimension both laterally and circumferentially while other portions that have not yet been contacted by the hot coke remain relatively unaffected. Thus, stress levels within the vessel sidewall 28 are highly localized, at least in an elevational manner. The increase in the vessel sidewall and temperature as the coke enters the vessel however is not the factor that causes the greatest stress and, therefore, the greatest rate of deterioration of the vessel sidewall. Instead, after the drum is substantially filled with liquid coke, that builds up in solidified layers, the maximum stress on the sidewall occurs as the quenching process begins. To cool the coke within the drum to near ambient temperature so that it can be extracted as a solid material for subsequent disposal and use, the standard technique is to quench the coke by introduction of water which is available through conduit 30. The water passes through a controlled valve 32 to conduit 34 by which the water enters into the lower end 20 of vessel 10. The system of this invention is concerned with controlling valve 32 so that the rate and timing of water entry into coke drum 10 is controlled in such a way that stresses are managed in a way to result in decreased rate of deterioration of vessel sidewall 28.

To accomplish this result, the system of this invention measures the stress in vessel sidewall 28 directly by the use of at least one but preferably a plurality of strain gauges. In the diagrammatic illustration of the drawing, three different patterns of strain gauge orientations are illustrated by way of example. In the lower most example, vessel sidewall has strain gauges 36 that are vertically oriented, that is longitudinally oriented, in a spaced apart pattern. A strain gauge, as is well known to those experienced in the art of stress measurement, functions to respond to change in dimension of a physical object to which it is attached by creating a measurable electrical signal. This electrical signal can be created, such as by the strain gauge changing in resistance in response to a change of dimension or by the generation of an electric voltage potential. This electrical signal is derived from a pair of conductors connected to each strain gauge 36. For instance, at the right hand of the lowermost portion of the vessel sidewall 28 a representative strain gauge 36 has a first electrical contact point 36A and a second electrical contact point 36B. By means of conductors 38A and 38B, an electrical signal is provided that is fed to a computer 40. The term "computer" is utilized in its broadest sense, that is, the term includes all of the electrical circuitry utilized in practicing the invention to employ a measurement obtained from conductors 38A and 38B of a transistor 36 to ultimately provide a control signal for valve 32.

Strain gauge 36 each has a contact point 36B that is elevationally positioned above a contact point 36A and, thus, the strain gauges 36 are oriented to respond to longitudinal stresses in the vessel sidewall 28.

An intermediate section 28B of vessel sidewall has strain gauges 42 that are oriented horizontally in a pattern. In the right hand portion of the drawing, strain gauge 42 as an example of the other strain gauges 42, has contact points 42A and 42B to which are connected conductors 44A and 44B by which signals are supplied to computer 40. Strain gauges 42 in the illustrated pattern respond primarily to stress in the vessel sidewall that is circumferential.

Vessel sidewall section 28C has strain gauges 46 oriented at an angle relative to the vertical and also at an angle relative to the circumferential. The right hand most strain gauge 46 is shown with contact points 46A and 46B with contact point 46A mounted longitudinally above and circumferentially displaced relative to contact point 46B. Thus the orientation of strain gauge 46 will respond to both longitudinal stress and circumferential stress. By means of conductors 48A and 48B, a signal produced by representative strain gauge 46 is supplied to computer 40.

As the level of quench water rises within vessel 10, the stress on the vessel sidewall 28 is detected by strain gauges, whether a gauge is oriented as illustrated by the numerals 36, 42 and 46 or by some other orientation or pattern of orientations.

Computer 40, as has been previously stated, is representative of the total circuitry by which signals from strain gauges at various levels of the vessel are processed to provide an output signal on conductor 50 to control valve 32.

Valve 32 can be controlled by turning the valve on or off to start and stop the flow of quench water into coke drum 10 or valve 32 can be controlled to regulate the rate of flow, that is, to change the flow from a faster rate to a slower rate and vice versa.

Computer 40 includes software designed to utilize the information provided by one or more strain gauges to control the quenching rate so that the stress within the vessel sidewall 28 remains below a preselected maximum that would cause excessive or accelerated deterioration of the vessel sidewall. This can be achieved basically in two ways. In a simplified arrangement, computer 40 can be made to function to shut off flow of water, that is, close valve 32 when a detected stress level reaches a certain maximum level and to maintain the water shut off until the stress level falls below the preselected maximum allowable stress, at which time valve 32 can be reopened to admit additional quenching water. This process is repeated until vessel 10 is filled and, thus, all of the coke therein cooled. Another method employs computer 40 to determine a rate of increase of stress in vessel wall 28 and, based on the rate of increase, to project a level of stress that would be beyond an accepted level and to thereby control valve 32. In a sense, this system employs a signal derived as a first differential of the equation representing the detected increase in stress in the vessel sidewall. A third program can combine both systems, that is, a program to control valve 32 in response both to the maximum detected level of stress in conjunction with the computed rate of increase of stress. Irrespective of the system employed, the program in computer 40 is that which achieves the most rapid quenching of coke while, at the same time, preventing stress in the vessel sidewall that is beyond an acceptable level.

Strain gauges of the type identified by numerals 36, 42 and 46 are commercially available. Experiments verifying the efficacy of the invention have been completed utilizing strain gauges manufactured by Tokyo Sokki Kenkyujo Co., Ltd. whose address is 8-2, Minami-Ohi 6-Chome, Shinagawa-Ku, Tokyo 140 Japan. Model AWH-8/-16 strain gauges manufactured by this company have been used on coke drums in accordance with this invention. The strain gauges were used in accordance with the specification for use provided by this company. The model AWH-8/-16 is of the type previously referred to in the literature as an "Eaton (Ailtech) Weldable Strain Gauge, Model SG-425 ". The Tokyo Sokki Kenkyujo Company model AWH-8/-16 strain gauge is more or less a modern version of the Ailtech Model SG-425 strain gauge.

The listing of this particular strain gauge is by example only as other manufacturers market strain gauges that can be used to accomplish the purpose of this invention.

It is well known that in utilizing a signal from or generated by a strain gauge that temperature compensation is necessary. It is understood that each of the strain gauges herein is accompanied by temperature compensation employing techniques well known in the industry. One method of temperature compensation employs a thermocouple 52 affixed to the drum sidewall adjacent the pattern of strain gauges 36. A temperature indicating signal is fed to computer 40 by conductor 54. Computer 40 employs the detected temperature to compensate the signals received from the pattern of strain gauges.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A method of controlling the quench of coke in a coke drum to reduce the rate of deterioration of the coke drum sidewall comprising:

admitting water into a hot coke drum to cool coke therein;

determining the stress imposed on the coke drum sidewall by means of at least one strain gauge affixed to the sidewall; and controlling the admission of water into the coke drum in response to the determined stress to a rate that results in the determined stress remaining below a preselected maximum level.

2. A method of controlling the quench of coke in a coke drum according to claim 1 wherein said coke drum sidewall is cylindrical and vertical and wherein at least one strain gauge measures stress from a first to a second point on said vessel sidewall in which the second point is vertically displaced relative to the first point.

3. A method of controlling the quench of coke in a coke drum according to claim 1 wherein said coke drum sidewall is cylindrical and vertical and wherein at least one strain gauge measures stress from a first to a second point on said sidewall in which the second point is circumferentially displaced relative to said first point.

4. A method of controlling the quench of coke in a coke drum according to claim 1 in which said step of determining the stress imposed on the coke drum sidewall includes measuring the temperature of the coke drum sidewall at the area thereof wherein said strain gauge is affixed and including the step of using the measured temperature to provide a compensated stress measurement.

5. A method of controlling the quench of coke in a coke drum according to claim 1 wherein said coke drum sidewall is cylindrical and vertical and wherein a plurality of strain gauges are affixed to said coke drum sidewall, at least some of said strain gauges being vertically positioned relative to others and at least some of said strain gauges being circumferentially positioned relative to others.

6. A method of controlling the quench of coke in a coke drum according to claim 1 including at least two strain gauges in vertical and spaced apart orientation on said coke drum sidewall.

7. A method of controlling the quench of coke in a coke drum according to claim 1 including a plurality of strain gauges affixed to said coke drum sidewall in groups, the groups being at different elevational levels.

8. A method of controlling the quench of coke in a coke drum according to claim 1 including the step of determining the rate of increase of stress imposed on the coke drum sidewall and controlling the rate of admission of water into the coke drum in response to the determined rate of stress increase.

9. A method of controlling the quench of coke in a coke drum according to claim 8 in which the rate of admission of water into the coke drum is controlled by a computer having a program responding to a combination of the determined stress and the determined rate of stress increase in the vessel sidewall.

* * * * *